US006467623B1

(12) United States Patent
Lewis et al.

(10) Patent No.: US 6,467,623 B1
(45) Date of Patent: Oct. 22, 2002

(54) APPARATUS FOR STORING STRINGS OF LIGHTS AND ACCESSORIES

(76) Inventors: John Gordon Lewis, 1034 Eagle Point Dr., Southpointe, PA (US) 15315-7523; Marlana Cornelia Lewis, 1034 Eagle Point Dr., Southpointe, PA (US) 15315-7523

( * ) Notice: Subject to any disclaimer, the term of this patent is extended or adjusted under 35 U.S.C. 154(b) by 0 days.

(21) Appl. No.: 09/865,131

(22) Filed: May 24, 2001

(51) Int. Cl.[7] ..... B65D 85/42

(52) U.S. Cl. ..... 206/575; 206/388; 206/419; 206/702; 211/163

(58) Field of Search ..... 206/418–422, 206/526, 575, 388, 702; 211/26, 26.2, 70, 78, 95, 163, 165, 166; 220/629; 223/106, 107; 248/131; 312/249.1, 249.2, 269

(56) References Cited

U.S. PATENT DOCUMENTS 4,269,461 A * 5/1981 Roach, Jr. ..... 206/564
4,437,713 A * 3/1984 Roach ..... 206/526
4,771,206 A * 9/1988 Taylor ..... 211/70
4,917,323 A * 4/1990 Wing ..... 206/419
D339,976 S 10/1993 Ferguson, Sr.
5,287,965 A * 2/1994 Miller ..... 206/420
5,641,075 A * 6/1997 Mechlin ..... 206/419
5,653,339 A 8/1997 Dobson
5,661,953 A 9/1997 Jolley
5,676,250 A * 10/1997 Walters ..... 206/419
5,816,407 A 10/1998 Daratony
5,868,334 A * 2/1999 Cedillo ..... 206/420
5,941,388 A 8/1999 Spielberger
5,988,384 A 11/1999 Stoner et al.
5,992,627 A * 11/1999 Lai ..... 206/702
6,053,322 A * 4/2000 Kim et al. ..... 206/575
6,193,080 B1 * 2/2001 Castillo ..... 211/66

* cited by examiner

*Primary Examiner*—Jim Foster
(74) *Attorney, Agent, or Firm*—Richard V. Westerhoff; Eckert Seamans Cherin & Mellott, LLC

(57) ABSTRACT

Apparatus for storing strings of lights and accessories includes a container with a side wall having an upwardly and inwardly extending outer surface, between upper and lower radial flanges, on which the strings of light are wrapped, and subsequently unwrapped, as the container rotates about a vertical pivot mounted on a base. The container has an internal cavity accessible through a central lid covered opening in which accessories, such as ornaments and the like, are supported on circumferentially spaced, radially inwardly directed hangers alternately secured at staggered heights to the container side wall. Below the hangers are compartments for other accessories, especially fragile ornaments, which extend around a vertical post supporting a large tree topping ornament. A hood can extend down over the side wall to protect the strings of lights. A handle or hook for lifting and hanging the apparatus can project through an opening in the hood.

19 Claims, 5 Drawing Sheets

APPARATUS FOR STORING STRINGS OF LIGHTS AND ACCESSORIES

BACKGROUND OF THE INVENTION

1. Field of the Invention

This invention relates to storage apparatus, and particularly to apparatus for storing strings of lights such as Christmas tree lights and accessories such as ornaments and other decorations.

2. Background Information

Every year Christmas lights and ornaments must be recovered from storage for display and then repacked after the holidays. Often the strings of lights become tangled and bulbs and fragile ornaments can be broken.

Various solutions to these annual chores have been proposed. There are many suggestions for freestanding or rotatable frames on which the strings of lights can be wrapped. Typically, the fragile ornaments are individually wrapped and packed in boxes. It has been suggested that the ornaments could be suspended from hooks depending from the top wall of a storage box with the ornaments inserted and retrieved through a door in a side wall of the box. Receptacles for storing the strings of lights and ornaments together have also been proposed. In one, the strings of lights are wrapped around posts in a storage box with the ornaments retained between cloth bands looped over other posts. In another, the light strings are wrapped around frames, which are suspended within a rectangular box with the ornaments stored in spaces created between other suspended frames.

There is no really efficient arrangement for storing and retrieving strings of lights and accessories. In most cases, the lights and ornaments are stored separately. Even those that store all of the decorations together, none provide a convenient arrangement for packing away and feeding out the strings of lights which eliminates tangling and at the same time provides secure and easily accessible storage for the accessories, such as fragile ornaments including the large ornaments that often adorn the top of a Christmas tree.

Hence, there is clearly room for improvement in an apparatus for storing strings of lights and accessories.

SUMMARY OF THE INVENTION

More particularly, the invention is directed to apparatus for storing strings of lights and accessories comprising a container having a side wall with an outer surface adapted to retain strings of lights wrapped around the surface and defining an internal cavity adapted to contain the accessories. The container can have hangers and/or compartments in the internal cavity adapted to store the accessories. The hangers, for example, can be elongated hooks extending laterally inward within the cavity. Where the container side wall is a surface of revolution, the elongated hooks can extend radially inward, and to provide more efficient packing of the accessories suspended from the hooks they can be staggered in height. The compartments can be arranged circumferentially around the bottom of the internal cavity, and if needed, a central post can be provided to support a large ornament such as that mounted on the top of the Christmas tree.

The outer surface of the container side wall can be a surface of revolution which extends upward and inward. A lower flange extending radially outward from the lower end of the side wall and an upper flange extending radially outward from an upper end of the side wall can be provided.

As another aspect of the invention, a hood can be provided which extends down over the side wall to protect the strings of lights wrapped around the outer surface of the container side wall. Support members can be provided on the outer surface of the hood for storing additional accessories.

Preferably, the apparatus for storing strings of lights and accessories has a base with a substantially vertical pivot axis on which the container is mounted for rotation. Thus, by rotating the container the strings of lights can be easily, and without tangling, wrapped around the outer surface of the side wall of the container. Similarly, the strings of lights can be retrieved by simply pulling on the free end to unwind the string.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
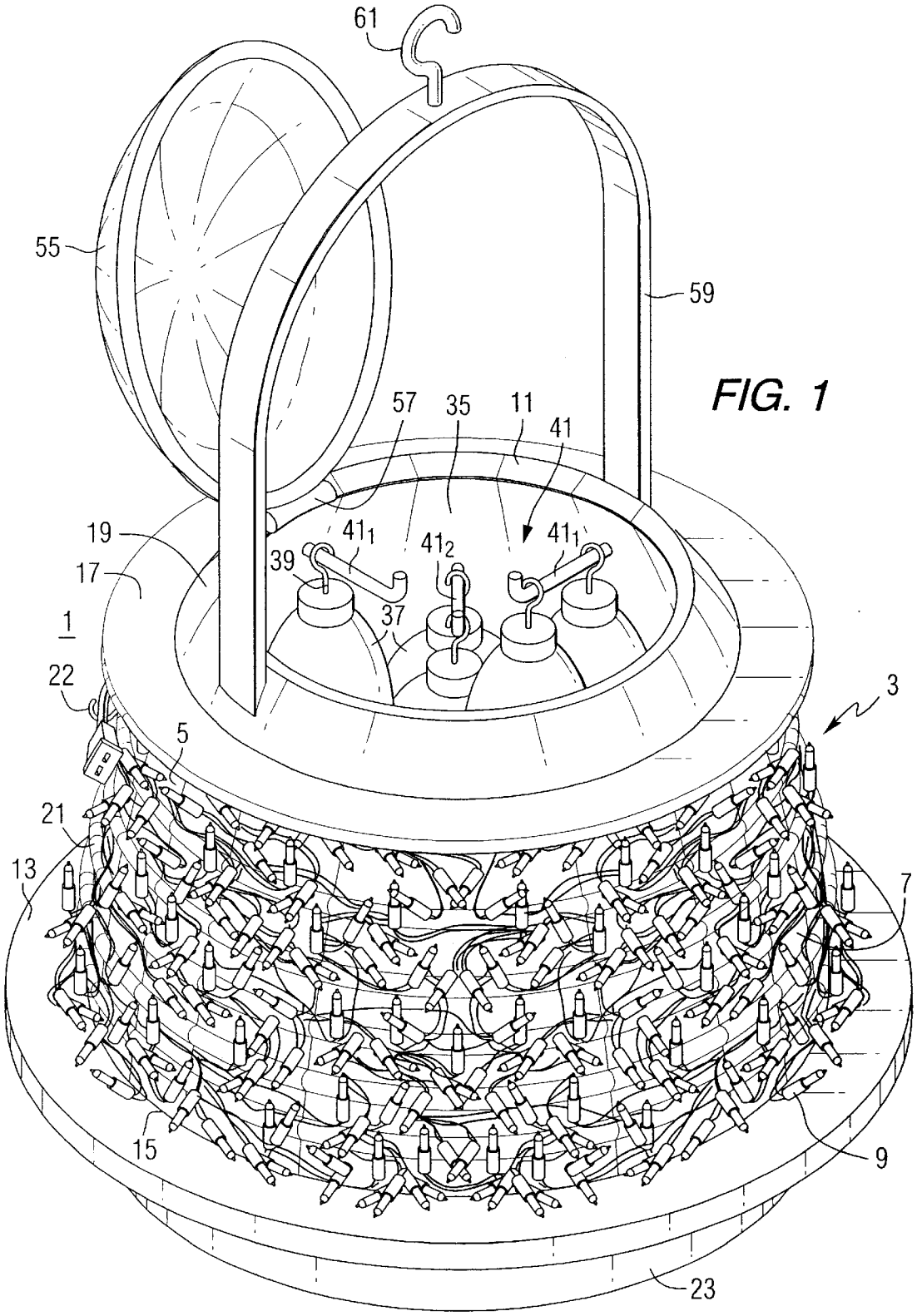
FIG. 1 is an isometric view of apparatus in accordance with the invention.
Figure 2:
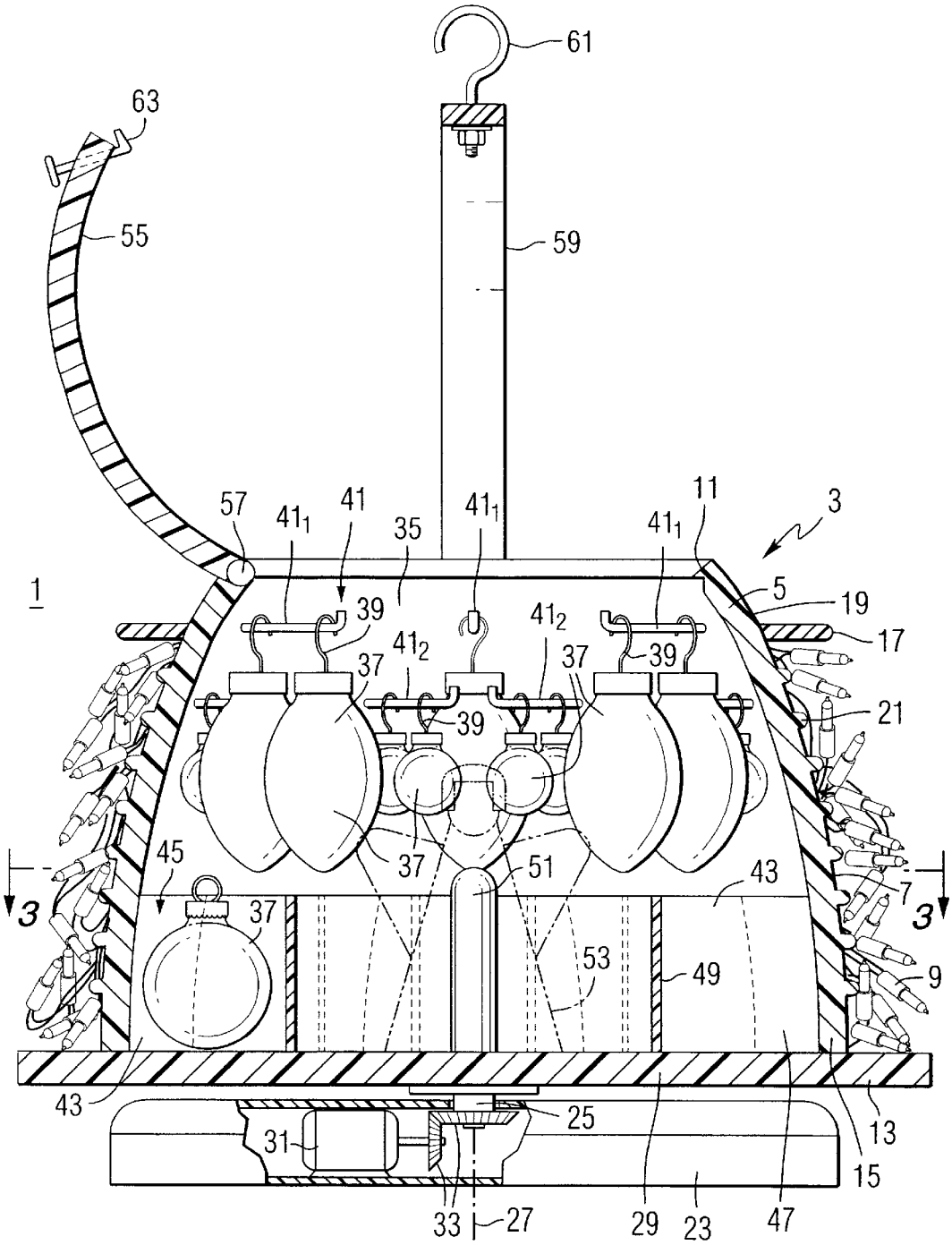
FIG. 2 is a vertical section through the apparatus of FIG. 1 with parts cut away.
Figure 3:
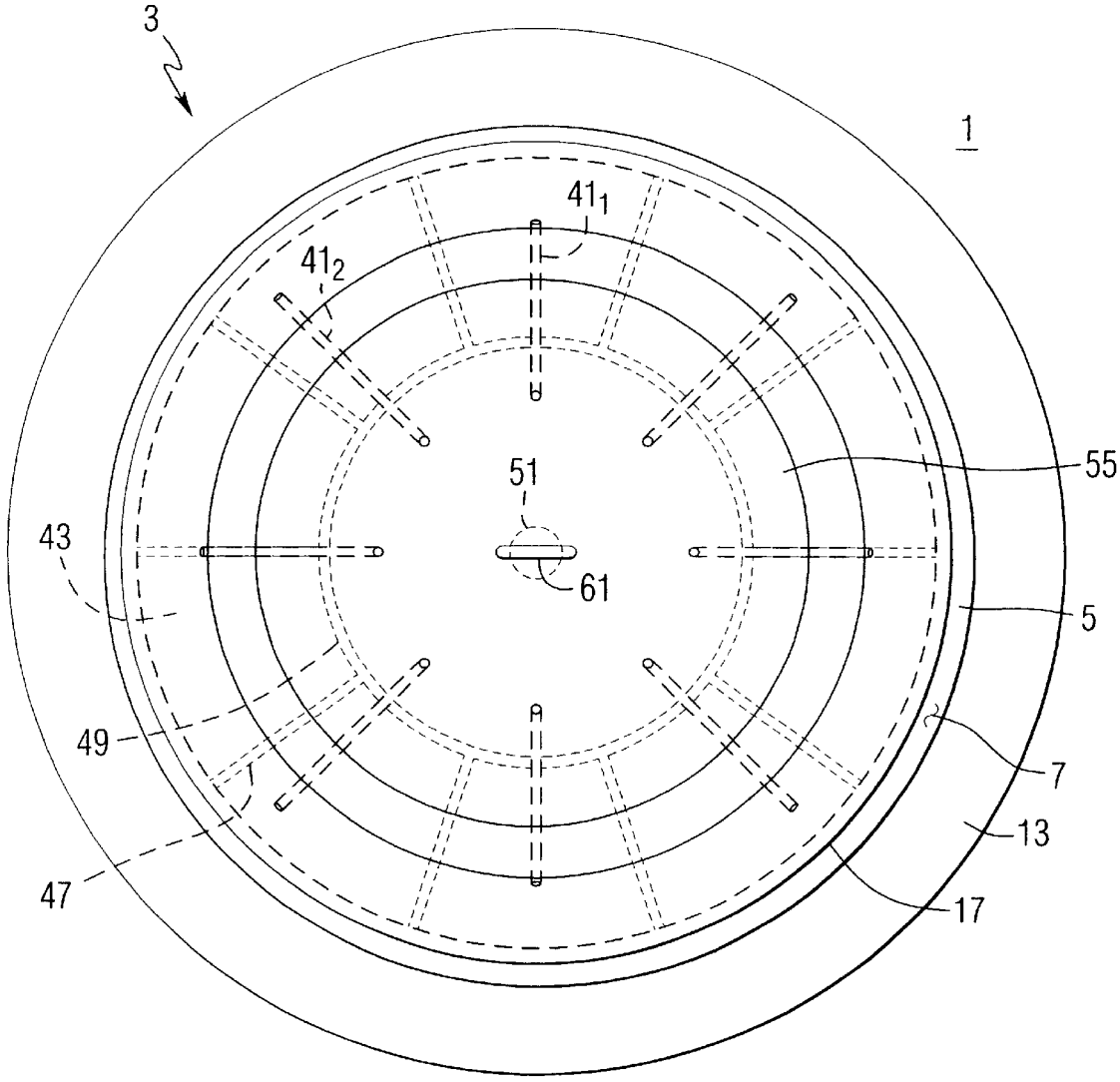
FIG. 3 is a top plan view of the apparatus of FIG. 1 with the light strings and ornaments removed for clarity.
Figure 4:
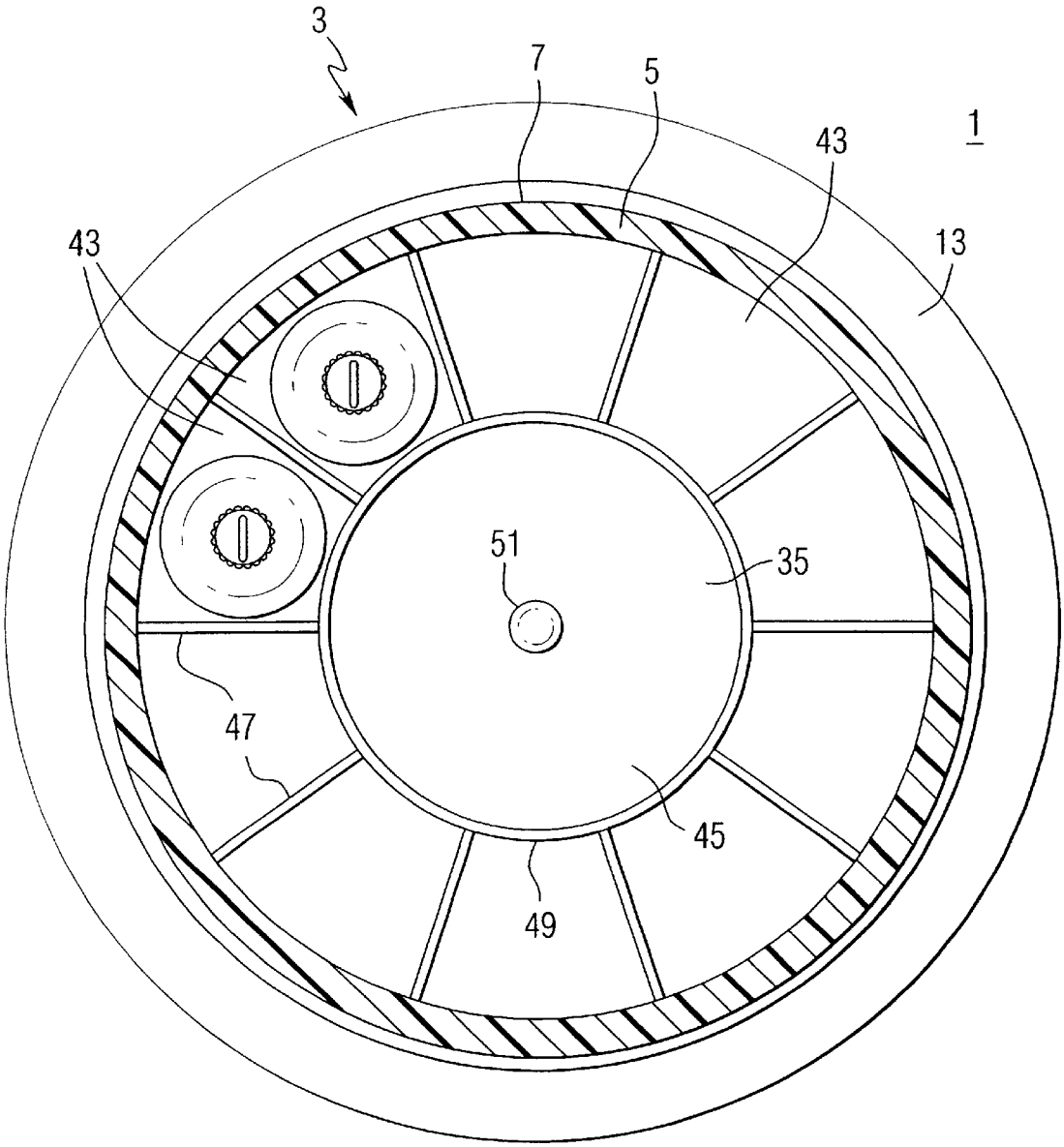
FIG. 4 is a horizontal section through the apparatus taken along the line 3—3 in FIG. 2, again with the light strings and ornaments removed for clarity.

Referring to FIGS. 1–4, the apparatus for storing strings of lights and accessories 1 in accordance with the invention, includes a container 3 having a side wall 5. This side wall 5 has an outer surface 7 which is adapted to retain a string of lights 9 such as Christmas tree lights wrapped around the outer surface 7. Preferably, the outer surface 7 of the container side wall 5 is a surface of revolution and extends upward and inward to terminate in a circular container opening 11.

The apparatus 1 further includes a lower flange 13 extending around the side wall 5 adjacent a lower end 15 of the side wall and extending laterally outwardly beyond the outer surface 7 of the side wall. The apparatus 1 can also include an upper flange 17 also extending around the side wall 5, but adjacent to an upper end 19 and extending laterally outwardly beyond the side wall 5 of the container 3.

The outer surface 7 of the side wall 5 can be adapted to support the string of lights 9 in various ways. For instance, a plurality of concentric annular ridges 21 can be formed on the outer surface 7. Alternatively, or in addition to the annular ribs 21, the surface 7 can be made of a material or have a surface texture with a high coefficient of friction. A hook 22 secures the end of the string of lights 9 to the side walls 5.

The apparatus 1 can also include a base 23 having a vertical pivot 25 forming a vertical pivot axis 27. The container 3 is mounted on this pivot 25 for rotation about the pivot axis 27. In the embodiment of the apparatus 1 shown in FIG. 2, the container bottom wall 29 is secured to the pivot 25. In this exemplary embodiment of the apparatus 1, the lower flange 13 is integral with this bottom wall 29, although it can be a separate attachment. If desired, a motor 31 can be incorporated into the base 23 and coupled to the pivot 25 through a pair of bevel gears 33 or other suitable coupling for automatically rotating the container.

The container 3 has an internal cavity 35 which is accessible through the opening 11 for storing accessories such as ornaments, spare bulbs, plugs, ornament hangers, and any other such objects. Ornaments 37 supported by ornament hooks 39 are suspended from hangers 41. In the exemplary embodiment of the invention, these hangers 41 are in the form of elongated hooks, which extend radially inward from the side wall 5. This arrangement of the hangers 41 permits any desired ornaments 37 to be lifted out of the internal cavity 35 without the necessity to remove any of the other ornaments. The hangers 41 are circumferentially spaced with alternate hangers $41_1$ and $41_2$ mounted at staggered heights for more dense storage. Alternatively to the hangers 41, or preferably in addition to the hangers, a number of compartments 43 are spaced around the interior cavity 35. Preferably, these storage compartments 43 are arranged around the periphery of the bottom portion 45 of the internal cavity where they are formed by radially inwardly directed partitions 47 and a central circular wall section 49. These compartments 43 can be utilized for storing the more fragile ornaments or as sub-containers for parts such as additional bulbs and the like. The internal cavity 35 can also be fitted with posts such as the central post 51 upon which a large ornament, such as a star or the angel 53 shown in phantom in FIG. 2, can be supported.

The opening 11 is provided with a lid 55 which may be completely removable, or secured to the container by a hinge 57. The apparatus 1 also includes a support member such as the handle or bail 59 shown in FIG. 1. This handle or bail 59 may be fixed as shown or can fold down for storage. If desired, the support member may further include a hook 61 on the handle. Alternatively, the support member may take the form of a hook on the lid 55. In the latter case, a latch 63 is provided to latch the lid closed for suspension by the hook. Provision of such a hook permits the apparatus 1 to be suspended, such as from a clothes rod in the rear of a closet, thereby utilizing storage space not normally used.

In use, a string of lights 9, or usually several strings of lights plugged together, are wrapped around the outer surface 7. Advantageously, where the container 3 is rotatably mounted on the base 23, the container can be rotated, either by hand or by the motor 31, to wrap up the lights on the outer surface 7. Some of the ornaments 37, or other accessories (not shown), can be placed in the compartments 43. In addition, a large ornament such as the angel 53 can be mounted on the post 51. Additional ornaments 59 are then suspended from the hangers 41. The lid 55 may then be closed and the apparatus 1 can be lifted for movement to storage either by the bail 59 or the hook 61.

When the strings of lights 9 and/or the ornaments 37 are again needed, the apparatus 1 can be removed from storage. The strings of lights 9 can be unwound from the outer surface 7 of the container. Where the container is mounted on a base 23, this is best accomplished by simply pulling on the string of lights 9. If the lights are pulled at an upward angle, the upper flange 17 prevents multiple turns of the light strings from being removed at the same time. The ornaments and other accessories are then readily available by opening the lid 55.

Figure 5:
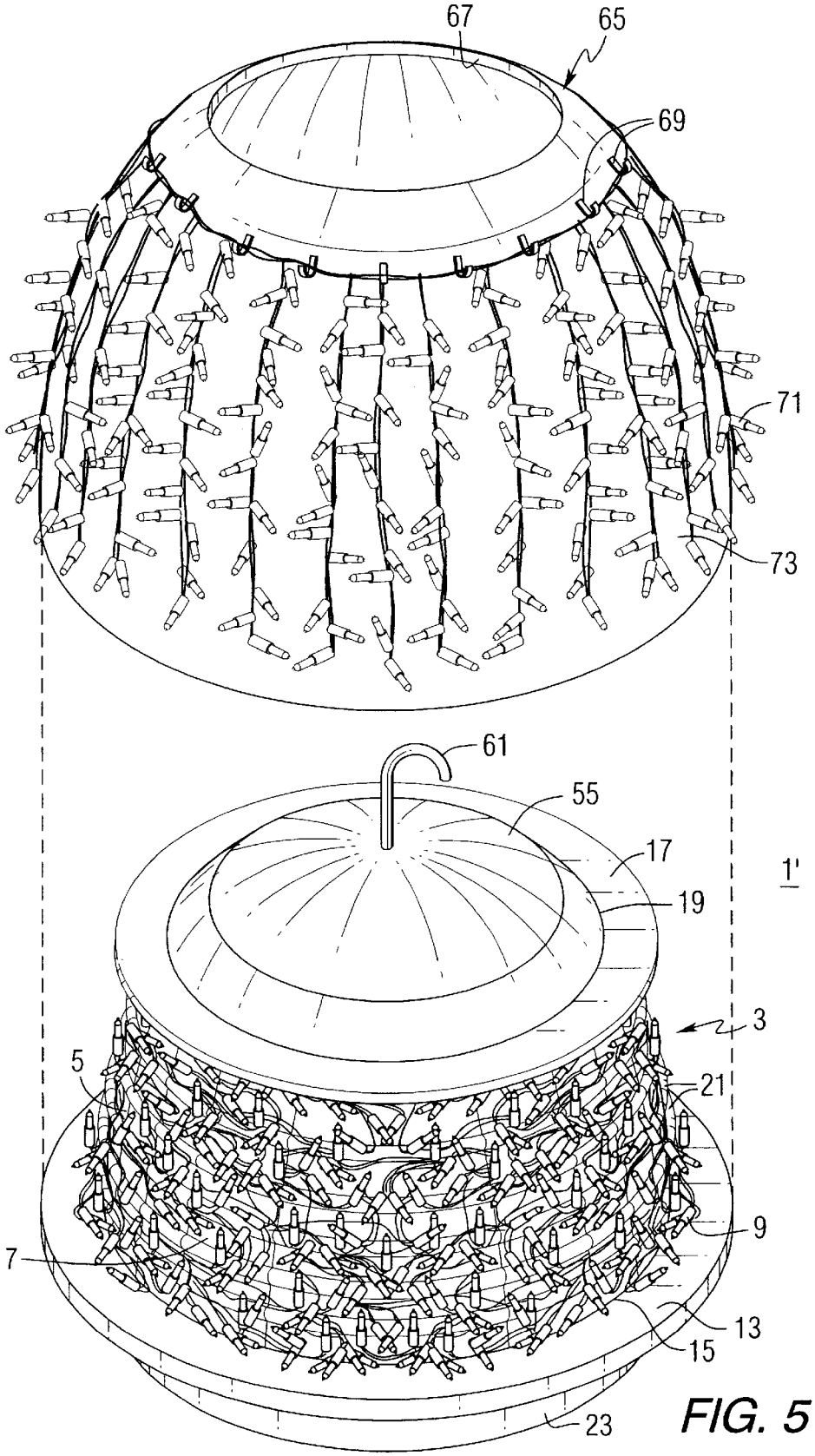
FIG. 5 is an exploded isometric view of another embodiment of the apparatus in accordance with the invention.

FIG. 5 discloses another embodiment of the invention, in which the apparatus 1' also includes a hood 65. This hood 65 passes down over the side wall 5 and seats on the lower flange 13 which may extend radially beyond the hood. The hood may fit snugly over the upper flange 17 so that it is centered and also protects the string of lights from dust during storage, as well as protecting them from physical damage. The hood 65 has a central opening 67 at the top through which the hook 61 secured to the lid 55 extends. Alternatively, or in addition, a handle or bail, such as shown in the embodiment of FIGS. 1–4, can be attached to the container 3 and extend through the opening 67 in the hood 65.

As another aspect of the invention, the hood may be provided with supports such as the additional hooks 69 from which additional accessories such as, for instance, the "icicle lights" 71 which have become popular, can be draped over the outer surface 73 of the hood. If desired, this outer surface 73 can have annular ribs and/or be made of a material or have a surface texture with a high coefficient of friction like the surface 7 on the side wall 5.

The apparatus of the invention provides a compact, efficient arrangement for storage and removal of strings of lights and accessories. It also provides protection from the ornaments and the lights, especially with the hood, while at the same time minimizing the chances of the strings of lights becoming entangled.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. Apparatus for storing strings of lights and accessories comprising: a container having a side wall with an outer surface adapted to retain the strings of lights wraped around the outer surface and defining an internal cavity adapted to contain the accessories, and a base having a substantially vertical pivot axis on which the container is mounted for rotation relative to the base about the substantially vertical pivot axis, wherein the outer surface of the side wall is a surface of revolution about the substantially vertical pivot axis, wherein the container has a top opening providing access to the internal cavity, and wherein the container has circumferentially spaced elongated members extending radially inward within the cavity adapted for suspending the accessories.

2. The apparatus of claim 1 wherein the container has compartments in the internal cavity below the elongated members and adapted for storing some of the accessories.

3. The apparatus of claim 1 wherein the container has a removable hood enclosing the side wall and the strings of lights wrapped on the outer surface of the side wall.

4. The apparatus of claim 3 wherein the hood has an outer surface with supports adapted to support additional accessories.

5. The apparatus of claim 1 wherein the container has a support member for lifting and suspending the container.

6. The apparatus of claim 1 wherein the base has a motor for rotating the container about the vertical pivot axis.

7. The apparatus of claim 1 wherein the surface of revolution curves upward and inward.

8. The apparatus of claim 7 wherein the container has a lower flange extending around the side wall adjacent a lower end and extending laterally outward beyond the outer surface of the side wall.

9. The apparatus of claim 8 wherein the container has an upper flange extending around the side wall adjacent an upper end of the side wall and extending laterally outward beyond the outer surface of the side wall.

10. The apparatus of claim 1 wherein the elongated members are positioned at alternating staggered heights within the internal cavity.

11. The apparatus of claim 1 wherein the container has a vertically extending post at a bottom of the internal cavity adapted to support an accessory.

12. The apparatus of claim 11 wherein the container has compartments arranged around the bottom of the internal cavity and adapted to store accessories.

13. Apparatus for storing strings of lights and accessories comprising: a container having a side wall with an outer surface adapted to retain the stings of lights wrapped around the outer surface, and defining an internal cavity adapted to contain the accessories, wherein the outer surface of the side wall is a surface of revolution and extends upward and inward, wherein the container has a top opening providing access to the internal cavity, and wherein the container has hangers within the internal cavity adapted to hang the accessories within the in cavity.

14. The apparatus of claim 13 wherein the container has compartments in the internal cavity adapted for storing the accessories.

15. The apparatus of claim 13 wherein the outer surface of the side wall is a surface of revolution and curves upward and inward.

16. The apparatus of claim 15 wherein the outer surface of the side wall has at least one of concentric annular rings, and a texture with a high coefficient of friction.

17. Apparatus for storing strings of lights and accessories comprising: a container having a side wall with an outer surface adapted to retain the strings of lights wrapped around the outer surface and defining an internal cavity adapted to contain the accessories, and a base having a substantially vertical pivot axis on which the container is mounted for rotation relative to the base about the substantially vertical pivot axis, wherein the outer surface of the side wall is a surface of revolution about the substantially vertical pivot axis, wherein the container has a top opening providing access to the internal cavity, and wherein the container has hangers within the internal cavity adapted to hang the accessories within the internal cavity.

18. The apparatus of claim 17 wherein the outer surface of the side wall is a surface of revolution and curves upward and inward.

19. The apparatus of claim 17 wherein the outer surface of the side wall has at least one of concentric annular rings, and a texture with a high coefficient of friction.

* * * * *

UNITED STATES PATENT AND TRADEMARK OFFICE

CERTIFICATE OF CORRECTION

PATENT NO. : 6,467,623 B1
DATED : October 22, 2002
INVENTOR(S) : John Gordon Lewis et al.

It is certified that error appears in the above-identified patent and that said Letters Patent is hereby corrected as shown below:

Column 5,
Line 21, "in cavity" should read -- internal cavity --.

Signed and Sealed this

Eighteenth Day of February, 2003

JAMES E. ROGAN
*Director of the United States Patent and Trademark Office*